US008104786B2

(12) United States Patent
Fumagalli

(10) Patent No.: US 8,104,786 B2
(45) Date of Patent: Jan. 31, 2012

(54) BINDING FOR FIXING A SHOE TO A SNOWBOARD

(75) Inventor: Martino Fumagalli, Colico (IT)

(73) Assignee: Core S.R.L., Delebio (IT)

( * ) Notice: Subject to any disclaimer, the term of this patent is extended or adjusted under 35 U.S.C. 154(b) by 173 days.

(21) Appl. No.: 12/230,816

(22) Filed: Sep. 5, 2008

(65) Prior Publication Data

US 2009/0174172 A1 Jul. 9, 2009

(30) Foreign Application Priority Data

Jan. 7, 2008 (IT) ..... MI2008A0013

(51) Int. Cl.
*A63C 9/00* (2006.01)
*A63C 3/00* (2006.01)
*A63C 9/081* (2006.01)

(52) U.S. Cl. ..... 280/617; 280/11.36; 280/618

(58) Field of Classification Search ..... 280/607, 280/617, 618, 620, 623, 624, 626, 633, 11.36, 280/14.22, 14.23
See application file for complete search history.

(56) References Cited

U.S. PATENT DOCUMENTS

| | | | | |
|---|---|---|---|---|
| 6,099,018 | A * | 8/2000 | Maravetz et al. | 280/624 |
| 6,315,305 | B1 * | 11/2001 | Gien | 280/14.24 |
| 6,808,196 | B2 * | 10/2004 | Des Ouches | 280/636 |
| 7,287,776 | B2 * | 10/2007 | Papon | 280/636 |
| 2006/0170196 | A1 * | 8/2006 | Couderc | 280/607 |
| 2008/0122202 | A1 * | 5/2008 | Furr et al. | 280/626 |

FOREIGN PATENT DOCUMENTS

WO WO 2006077180 A1 * 7/2006

* cited by examiner

*Primary Examiner* — J. Allen Shriver, II
*Assistant Examiner* — Chiedu Chibogu
(74) *Attorney, Agent, or Firm* — Modiano & Associati; Albert Josif; Daniel O'Byrne

(57) ABSTRACT

A binding for fixing a shoe to a snowboard and the like comprising a base body that can be fixed to a snowboard and the like by an angular positioning disk with engagement of contact elements defined by the base body on the snowboard, elements for fastening a shoe being associable with the base body and elastic shock-absorbing elements being also associable and interposable between the snowboard and the like and the base body, the shock-absorbing elements at least partially surrounding the external lateral profiles of the rear region of the base body.

18 Claims, 7 Drawing Sheets

BINDING FOR FIXING A SHOE TO A SNOWBOARD

The present invention relates to a binding for fixing a shoe to a snowboard and the like.

BACKGROUND OF THE INVENTION

As is known, the bindings used on snowboards and the like are constituted generally by a base body, which has a central portion from which side walls protrude for connecting the rear spoiler and the forward and front bands for retaining the shoe.

The central portion of the base body has a central hole with generally frustum-shaped edges for engagement with an angular positioning disk, which can be fixed to the snowboard.

The base body protrudes with respect to the region affected by the positioning disk and is provided by means of a rigid structure which is fastened to the snowboard, thus constituting a stiffening element also for the snowboard.

This fact is particularly negative, because the possibility of free flexing of the snowboard when subjected to stresses is compromised or otherwise modified, since in the region affected by the base body the board cannot bend, since such plate is connected rigidly to the snowboard.

One solution to the problem is disclosed in patent application WO2006077180 and consists in connecting the base body to the snowboard by way of contact means that involve only the regions located proximate to the positioning disk.

Moreover, this solution provides for the use of elastic shock-absorbing means interposed between the snowboard and the base body if the contact means cited above are not present.

More precisely, known shock-absorbing means comprise a number of front and rear pads, which when fixed to the base body act as shock-absorbing elements.

The presence of the shock-absorbing means together with the minimization of the area of contact between the base body and the snowboard obviates to a substantial extent the drawbacks mentioned earlier, giving greater flexibility and stability to the assembly, ensuring optimum functionality of the binding.

These known types of bindings, however, are not devoid of drawbacks, which include the fact that the described shock-absorbing means are difficult to connect to the base body.

Another drawback of known types of bindings with shock-absorbing pads consists in that during the use of the binding such binding can be subjected to intense stresses, which can include flexings and/or torsions, causing an excessive compression of one or more pads; this compression can lead to contact between the rigid portion of the binding and the snowboard, thus affecting the stability of the system and/or ruining the snowboard proper.

SUMMARY OF THE INVENTION

The aim of the present invention is to eliminate the drawbacks mentioned above by providing a binding for fixing a shoe to a snowboard and the like that allows to reduce to a minimum the stiffening of the system formed by the snowboard and by the binding, giving better flexibility to the snowboard during its use.

Within this aim, an object of the present invention is to provide a binding for fixing a shoe to a snowboard and the like that prevents the rigid portion of the binding from coming into contact with the snowboard, preventing the latter from being ruined, even as a consequence of intense stresses.

Another object of the present invention is to provide a binding that allows to reduce drastically the vibrations transmitted from the board to the binding, thus improving, in addition to user comfort, also stability during use.

Another object of the present invention is to provide a binding that gives the greatest assurances of reliability and safety in use.

Another object of the present invention is to provide a binding that can be obtained easily starting from commonly commercially available elements and materials and is also competitive from a merely economical standpoint.

This aim and these and other objects, which will become better apparent hereinafter, are achieved by a binding for fixing a shoe to a snowboard and the like, comprising a base body that can be fixed to a snowboard and the like by means of an angular positioning disk for engaging contact means defined by said base body on said snowboard, means for fastening a shoe being associable with said base body and elastic shock-absorbing means being associable and interposable between said snowboard and the like and said base body, characterized in that said shock-absorbing means at least partially surround external lateral profiles of the rear region of said base body.

BRIEF DESCRIPTION OF THE DRAWINGS

Further characteristics and advantages of the present invention will become apparent from the description of a preferred but not exclusive embodiment of a binding for fixing a shoe to a snowboard and the like, according to the invention, illustrated by way of non-limiting example in the accompanying drawings, wherein.

DESCRIPTION OF THE PREFERRED EMBODIMENTS

Figure 1:
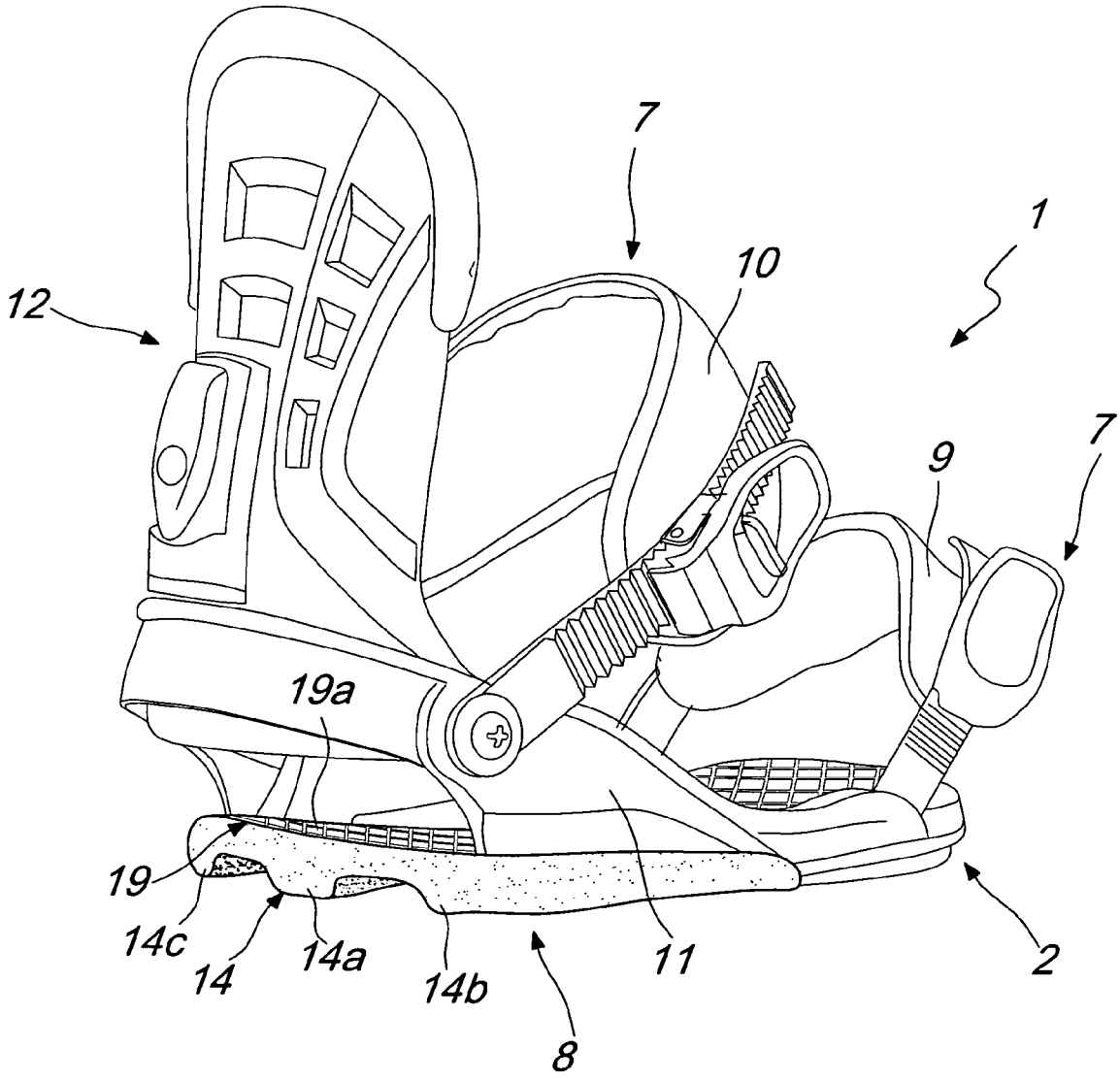
FIG. 1 is a perspective view of a binding for fixing a shoe to a snowboard and the like according to the present invention.
Figure 2:
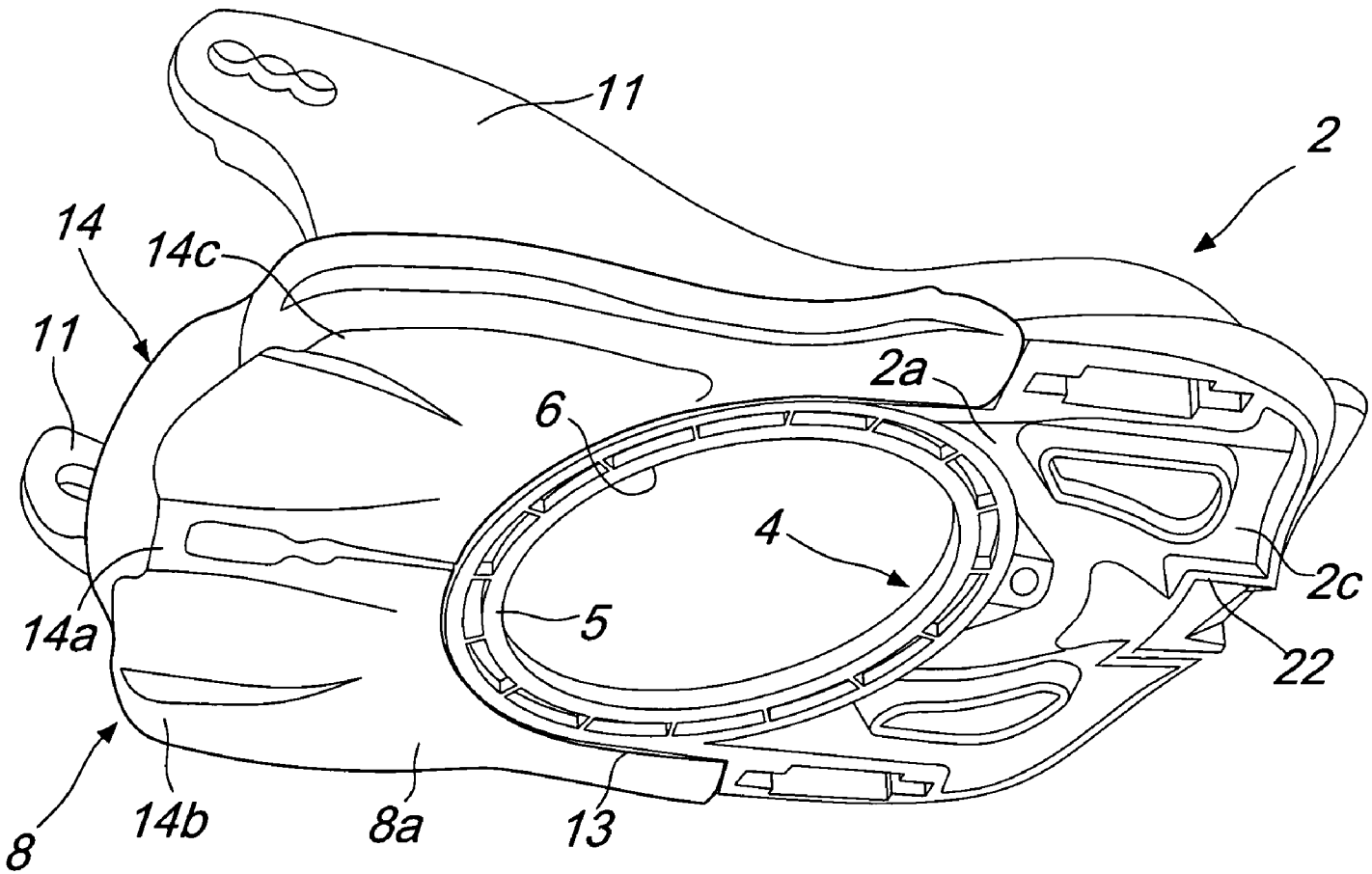
FIG. 2 is a perspective view of the base body according to the invention.
Figure 3:
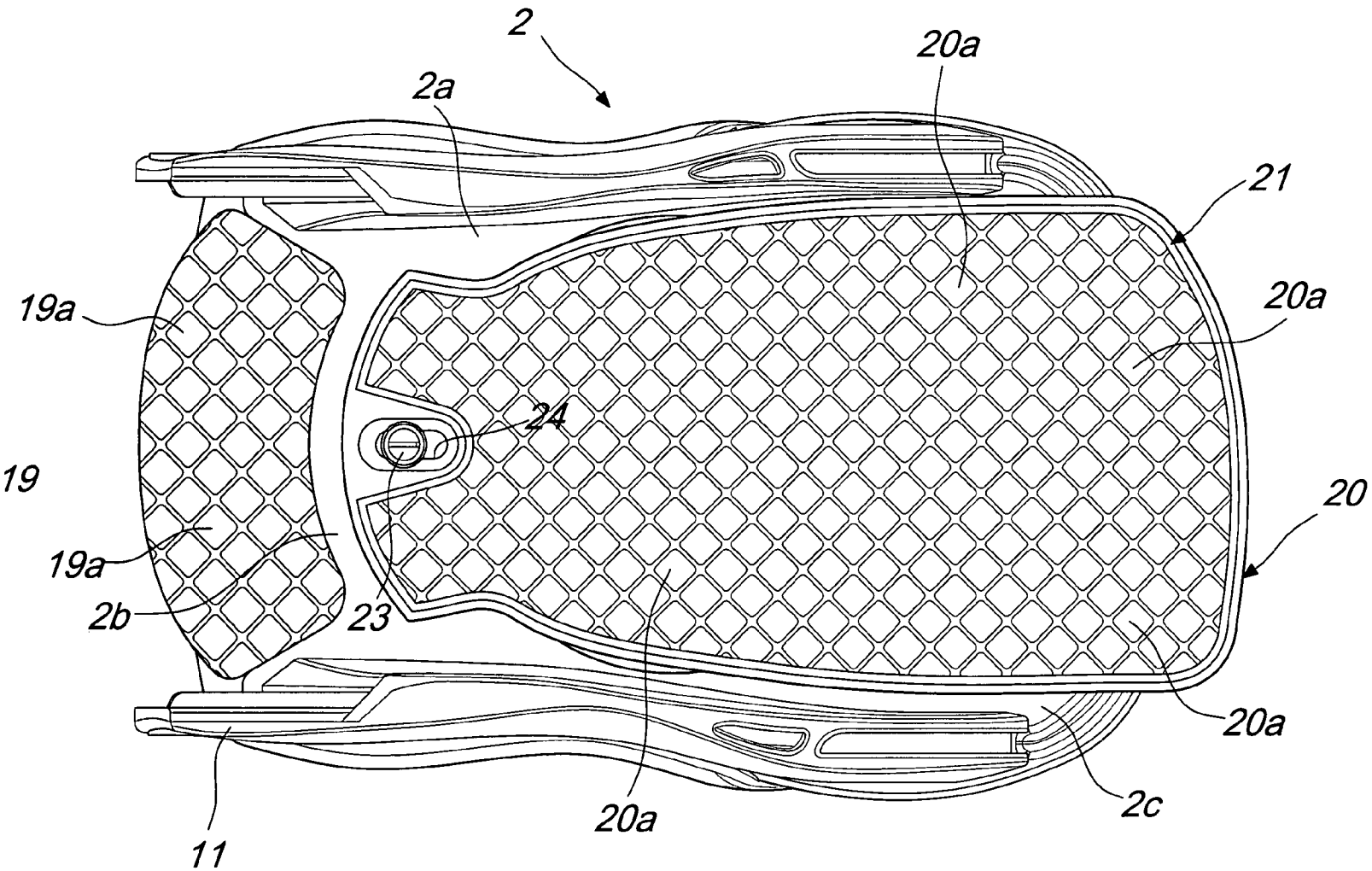
FIG. 3 is a top view of the base body of the binding according to the invention.
Figure 4:
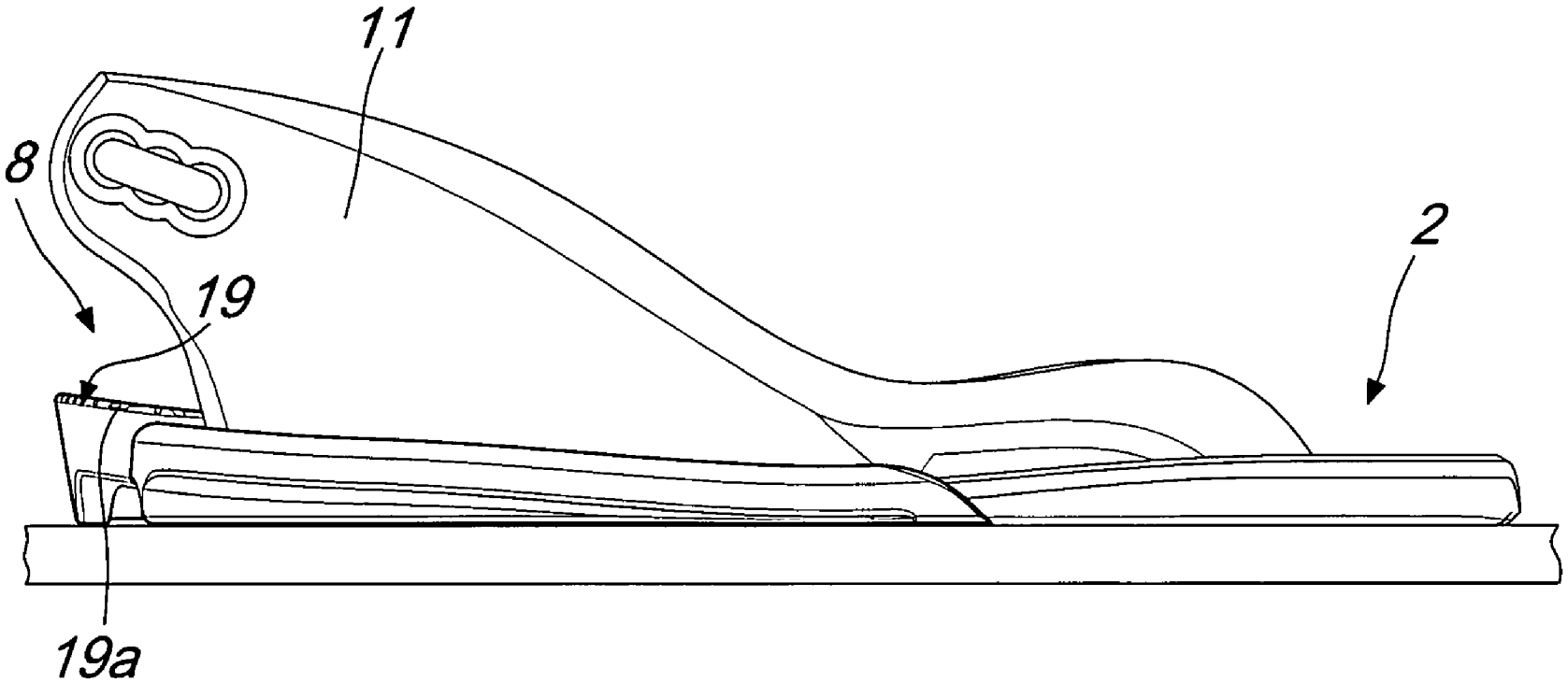
FIG. 4 is a side elevation view of the base body of the binding according to the invention.
Figure 5:
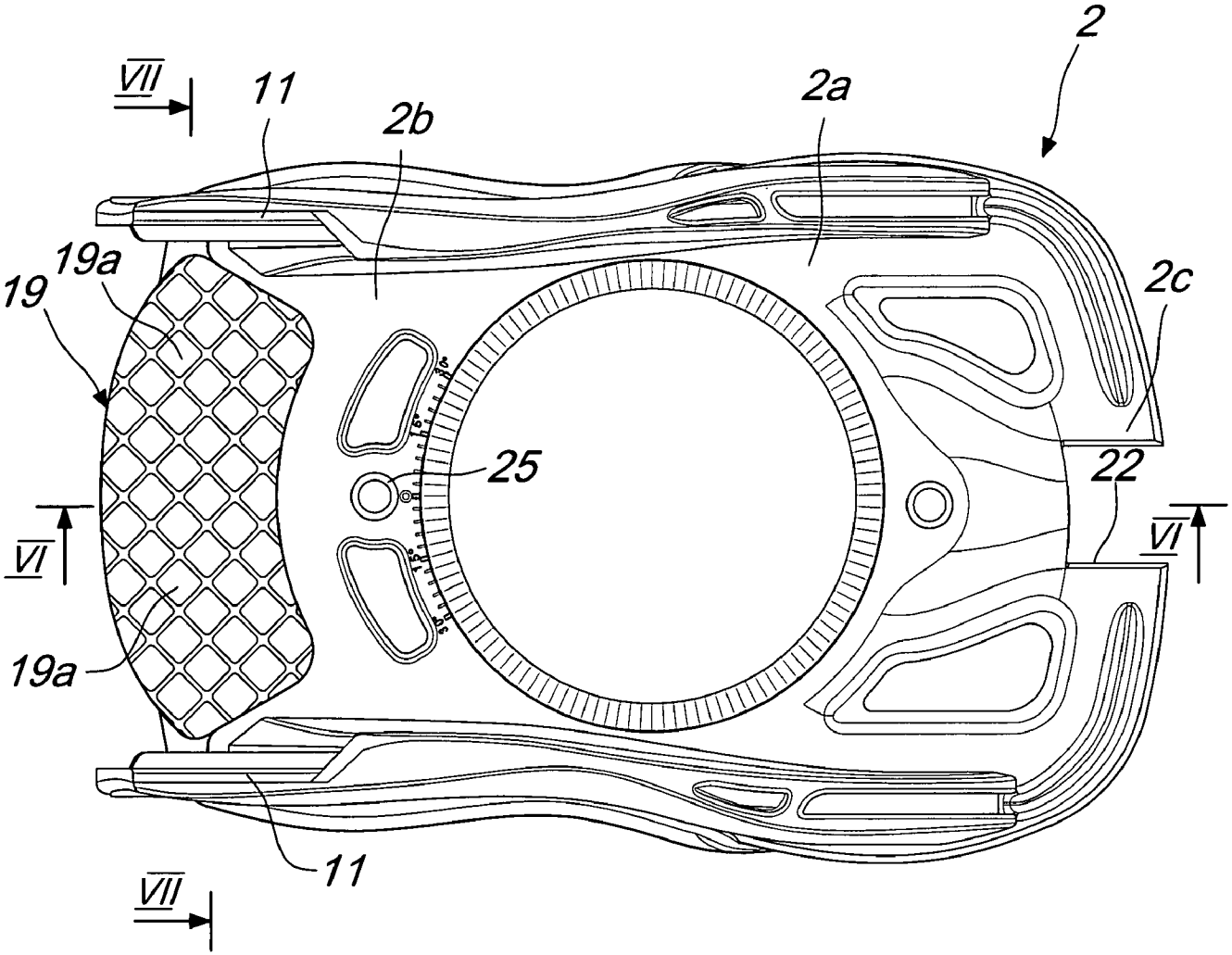
FIG. 5 is a top view of the base body shown in FIG. 4.
Figure 6:
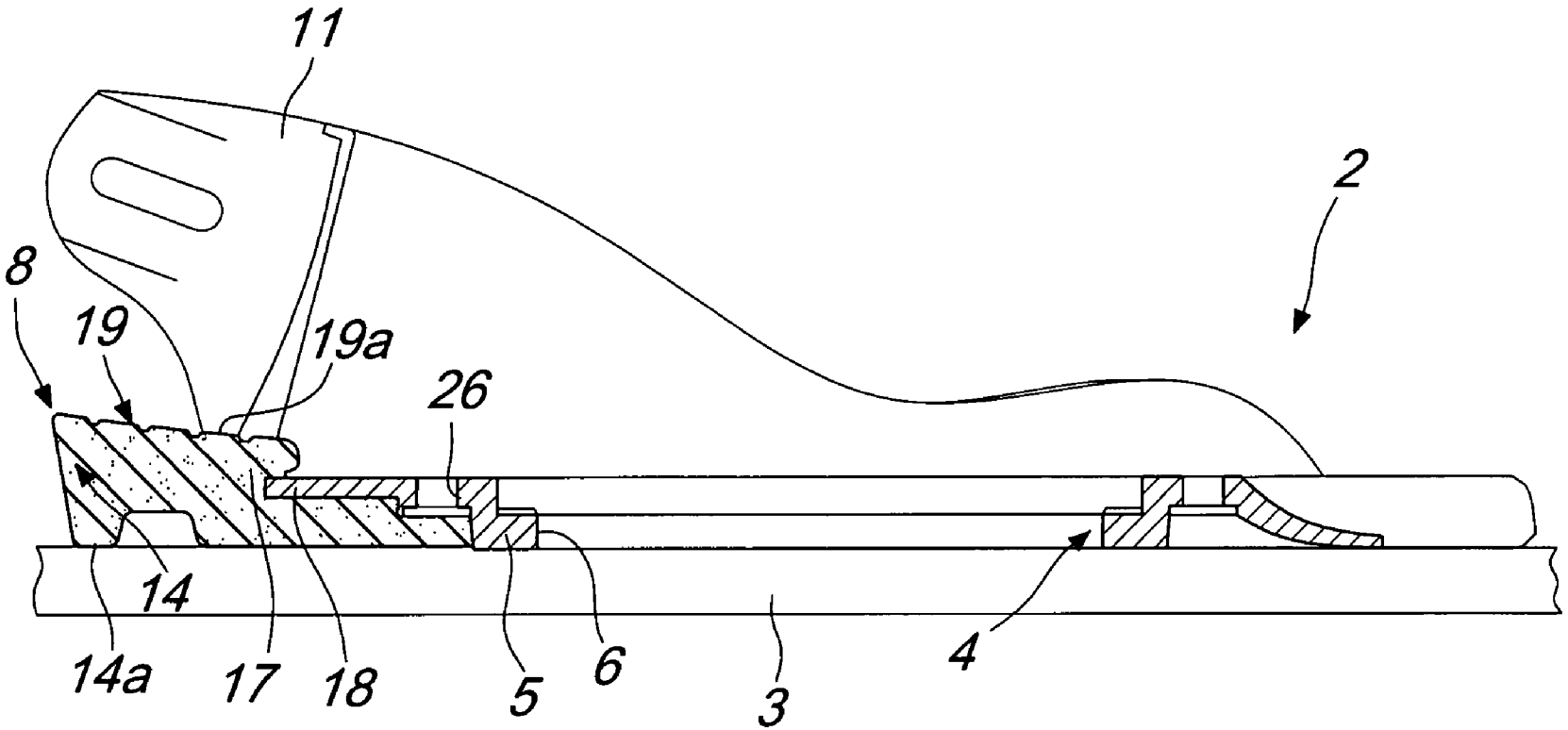
FIG. 6 is a sectional view, taken along the line VI-VI, of the base body shown in FIG. 5.
Figure 7:
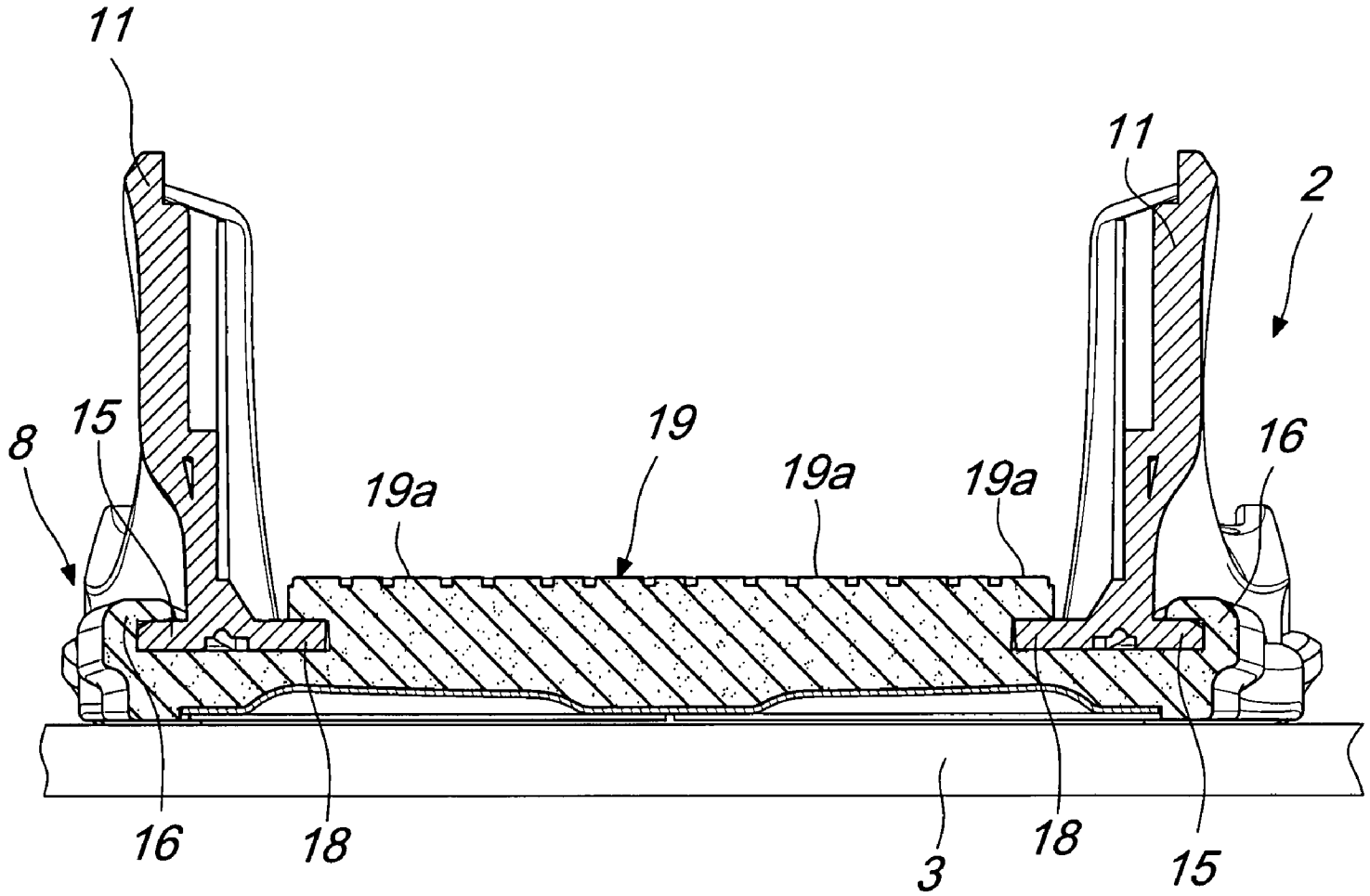
FIG. 7 is a sectional view, taken along the line VII-VII, of the base body shown in FIG. 5.

With reference to the figures, the binding for fixing a shoe to a snowboard and the like, generally designated by the reference numeral 1, comprises a base body 2, which can be fixed to a snowboard 3 and the like by means of an angular positioning disk, which is per se known and is therefore not shown, and by way of contact means 4, which are defined by the base body 2.

The contact means 4 comprise an annular element 5, which surrounds a circular opening 6 for mating with the ordinary angular positioning disk, which can be fixed in a per se known manner to the snowboard 3.

Both the annular element 5 and the circular opening 6 are defined by a central portion 2*a* of the base body 2.

It is possible to associate with the base body 2 means 7 for fastening a shoe, which is not shown, and it is possible to associate elastic shock-absorbing means 8, which can be interposed between the snowboard 3 and the like and the base body 2.

The fastening means 7 are constituted for example by a front band 9 and a rear band 10, which are not described in detail here since they are of a per se known type.

Side walls 11 extend from the central portion 2*a* for the connection of a rear spoiler or quarter 12 of a per se known type.

The shock-absorbing means 8 comprise a lower portion 8*a*, which is substantially flat and has a seat 13 that extends at least along a circular portion and surrounds the annular element 5.

The base body 2 is made of a rigid material which, for example, can be a synthetic material such as nylon in order to give stability to the connection between the snowboard 3 and the shoe.

Differently, the elastic shock-absorbing means 8 are made of a highly compression-deformable elastic material, such as for example EVA (ethylene vinyl acetate).

The choice of a synthetic material such as EVA can be particularly advantageous, since depending on the required characteristics and on the size of the user, a variation of the initial mix can give the shock-absorbing means different physical properties, such as for example hardness and elastic deformation coefficient.

At least one rear pad 14 for resting on the snowboard 3 protrudes from the lower portion 8*a*, affects the entire transverse width of the base body 2 and comprises three regions 14*a*, 14*b* and 14*c* for contact with the snowboard 3, which are arranged respectively centrally and laterally with respect to the base body 2.

The characterizing element of the invention consists in that the shock-absorbing means 8 surround at least partly the outer lateral profiles 15 at least in the rear region 2*b* of the base body 2, preventing their contact with the snowboard 3.

Two lateral borders 16 and a rear border 17 in fact protrude in a mutually continuous manner from the lower portion 8*a* and respectively surround at least partly the lateral outer profiles 15 and the rear outer profile 18 of the base body 2.

The rear border 17 comprises a fixed sole 19 for resting the heel of the shoe, which is provided with a first antislip surface 19*a*.

Moreover, there is a removable sole 20 for resting the sole of the shoe, which is provided with a second antislip surface 20*a* that is substantially coplanar to the first antislip surface 19*a*.

The removable sole 20 is associated with a supporting structure 21 which can be fixed, in at least three positions so as to adapt to different shoe sizes, to the base body 2 by way of fixing means which comprise a guiding element that is rigidly connected to the supporting structure and can be inserted in a slot 22, which is formed in the front portion 2*c* of the base body 2 and is oriented longitudinally.

Moreover, the fixing means comprise a threaded coupling which is provided between a screw 23, which is accommodated in a first seat 24 provided in an upward region on the supporting structure 21 and comprises three positions for fixing the screw 23, and a threaded nut 25, which is accommodated in a second seat 26 provided in a downward region on the base body 2.

Operation of the binding 1 according to the present invention is evident from the above description.

In particular, it must be stressed that the rear portion 2*b* of the base body 2, i.e., the portion that is subjected to greater load during use of the snowboard 3, is completely isolated from the snowboard 3, thus ensuring the sought flexibility.

In practice it has been found that the binding for fixing a shoe to a snowboard and the like according to the present invention fully achieves the intended aim and objects, since the shock-absorbing means are easy to fix to the base body and give the system high stability.

Another advantage of the binding according to the present invention consists in that the regions of contact of the rigid portions of the binding to the snowboard are limited to a minimum, thus preventing a reduction of the flexibility of said snowboard.

The binding for fixing a shoe to a snowboard and the like thus conceived is susceptible of numerous modifications and variations, all of which are within the scope of the appended claims.

All the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. MI2008A000013 from which this application claims priority are incorporated herein by reference.

What is claimed is:

1. A binding for fixing a shoe to a snowboard, comprising a base body that can be fixed to a snowboard with engagement of contact means defined by said base body on said snowboard, means for fastening a shoe being associable with said base body and elastic shock-absorbing means being associable and interposable between said snowboard and said base body, wherein said shock-absorbing means completely surround external lateral profiles of a rear region of said base body, preventing the direct contact of said external lateral profiles with the snowboard.

2. The binding according to claim 1, wherein said shock-absorbing means comprise a substantially flat lower portion, which has a seat that extends at least along a circular portion and surrounds an annular element for the coupling of said disk.

3. The binding according to claim 2, wherein at least one rear pad for contact against said snowboard extends from said lower portion.

4. The binding according to claim 3, wherein said rear pad extends along an entire transverse width of said base body and comprises three regions for contact with said snowboard.

5. The binding according to claim 2, wherein two lateral borders protrude from said lower portion and surround at least partially said lateral outer profiles of said base body.

6. The binding according to claim 5, wherein a rear border protrudes from said lower portion and surrounds at least partly a rear outer profile of said base body.

7. The binding according to claim 6, wherein said rear border and said lateral borders extend one after the other without discontinuity.

8. The binding according to claim 6, wherein said rear border comprises a fixed sole for resting the heel of said shoe.

9. The binding according to claim 8, wherein said fixed sole is provided with a first antislip surface.

10. The binding according to claim 9, comprising a removable sole for resting a sole of said shoe.

11. The binding according to claim 10, wherein said removable sole is provided with a second antislip surface, which is substantially coplanar to said first antislip surface.

12. The binding according to claim 10, wherein said removable sole is associated with a supporting structure that can be fixed to said base body by way of fixing means.

13. The binding according to claim 12, wherein said supporting structure can be fixed in at least three positions.

14. The binding according to claim 12, wherein said fixing means comprise a guiding element, which is rigidly connected to said supporting structure and can be inserted in a slot provided in the front portion of said base body, said slot being oriented longitudinally.

15. The binding according to claim 12, wherein said fixing means comprise a threaded coupling, which is provided between a screw accommodated in a first seat defined in an upper region on said supporting structure and a threaded nut which is accommodated in a second seat defined in a lower region on said base body.

16. The binding according to claim 15, wherein said first seat comprises three positions for fixing said screw.

17. The binding according to claim 1, wherein said base body is made of nylon.

18. The binding according to claim 1, wherein said shock-absorbing means are made of EVA.

* * * * *